US009859629B2

(12) United States Patent
Krebs et al.

(10) Patent No.: US 9,859,629 B2
(45) Date of Patent: Jan. 2, 2018

(54) CONTACT ELEMENT HAVING CONNECTOR PLATE AND CONDUCTOR RECEPTACLE

(71) Applicant: Lisa Draexlmaier GmbH, Vilsbiburg (DE)

(72) Inventors: Annika Krebs, Ergolding (DE); Wolfgang Wimmer, Salching (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 0 days.

(21) Appl. No.: 15/405,670

(22) Filed: Jan. 13, 2017

(65) Prior Publication Data

US 2017/0207553 A1 Jul. 20, 2017

(30) Foreign Application Priority Data

Jan. 14, 2016 (DE) ..... 10 2016 200 363

(51) Int. Cl.
*H01R 13/28* (2006.01)
*H01R 4/34* (2006.01)
*H01R 4/18* (2006.01)

(52) U.S. Cl.
CPC ..... *H01R 4/34* (2013.01); *H01R 4/18* (2013.01)

(58) Field of Classification Search
CPC ..... H01R 13/213; H01R 13/28
USPC ..... 439/288, 287, 883, 907
See application file for complete search history.

(56) References Cited

U.S. PATENT DOCUMENTS 5,834,696 A * 11/1998 Kurosawa ..... H01R 13/213 174/84 C
6,786,751 B2 * 9/2004 Maeda ..... H01R 11/12 439/287
8,105,121 B2 1/2012 Miyamoto et al.

FOREIGN PATENT DOCUMENTS

DE 10 2005 061 221 A1 6/2007
DE 11 2008 002 973 T5 9/2010
EP 0 663 703 A2 7/1995
EP 1 746 686 A1 1/2007

OTHER PUBLICATIONS

Office Action in German Application No. DE 10 2016 200 363.1, dated Nov. 25, 2016.

* cited by examiner

*Primary Examiner* — Phuong Dinh
(74) *Attorney, Agent, or Firm* — Finnegan, Henderson, Farabow, Garrett & Dunner LLP

(57) ABSTRACT

Embodiments disclose a contact element comprising a connector plate having a central inner opening and a conductor receptacle extending outwardly from the connector plate. The connector plate has at least one pair of connection areas including a plug area and a jack area. The plug area and the jack area of each particular pair are angularly offset by a predefined offset angle around a center of the inner opening and are vertically offset from one another in a direction perpendicular to the connector plate such that they are configured for mutual lateral engagement when arranged facing and vertically offset from one another. Further embodiments disclose a method for connecting two contact elements, and a set having multiple superimposed contact elements that are angularly offset by an offset angle. The contact elements of the present disclosure may be used to (Continued)

attach individual leads to a ground terminal in a vehicle body.

20 Claims, 8 Drawing Sheets

CONTACT ELEMENT HAVING CONNECTOR PLATE AND CONDUCTOR RECEPTACLE

CROSS REFERENCE TO RELATED APPLICATIONS

This application is based upon and claims the benefit of prior German Patent Application No. DE 10 2016 200 363.1, filed on Jan. 14, 2016, the entire contents of which are incorporated herein by reference.

TECHNICAL FIELD

The present disclosure relates to a contact element comprising a connector plate having a central inner opening and a conductor receptacle extending outwardly from the connector plate. The present disclosure also relates to a set of several stacked contact elements in which the connector plates of two superimposed contact elements lie on one another over a large area and are offset at an offset angle. The present disclosure further relates to a method of connecting two similar contact elements, both having a connector plate with a central inner opening and a conductor receptacle extending outwardly from the connector plate. The present disclosure is suitable for applications in which contact elements are used for attaching individual wires from multiple wires, bundled together in a single cable lug, to a ground terminal, such as a ground bolt in a vehicle body.

BACKGROUND

German Patent document DE 10 2005 061 221 A1 discloses a contact element for electrically bonding an electrical conductor to a bolt, particularly a ground terminal bolt, comprising a connector plate with a central opening and an elongated conductor receptacle extending in a radial direction referred to the geometric center of the central opening. The contact element includes at least one receiving means located on the outer edge of the connector plate and formed by a tongue that is open toward the geometric center of the connector plate and projects from the plane of the connector plate, forming at least one latching element on the connector plate.

German Patent document DE 11 2008 002 974 T5 discloses a ground terminal lug for attachment to a common ground together with at least one additional second ground terminal lug with the same design, in a stacked manner, comprising an annular connecting body with a passage opening which permits the passage of the ground portion; a cable attachment portion having a bottom wall and a pair of cylinder-jacket-shaped walls standing upright from the respective bottom wall, wherein the cable attachment portion can be fixed at one end of an electrical cable by means of a plastic deformation of the pair of cylinder-jacket-shaped walls; a clamping portion having an upright portion projecting from an outer peripheral edge of the connecting body in a direction opposite to that of the cylinder-jacket-shaped walls of the cable attachment portion and a distal end portion extending inwardly from the upright portion along the connector body; and a clampable portion formed along the outer peripheral edge to lie adjacent the clamping portion in the circumferential direction of the connecting body wherein the clamping portion is capable of clamping a clampable portion of the second terminal lug by accommodating this clamped portion between the distal end portion and the connecting body, to prevent a relative displacement between superimposed ground terminal lugs in the direction of overlap of the second ground terminal lug relative to the first ground terminal lug when the first ground terminal lug is placed onto the second ground terminal lug, wherein the distal end section of the clamping section may touch the ground part if the second ground terminal lug serves as the lowest ground terminal lug and the ground part passes through the passage opening, to prevent this lowest ground terminal lug from rotating relative to the ground part.

European Patent document EP 1 746 686 B1 discloses an electrical connector element to connect an electrical conductor to a bolt, particularly a ground bolt, comprising a substantially circular connector plate with a central opening for placing the connector element onto the bolt, and a receiving area for an electrical lead elongated in a radial direction with respect to the connector plate, with at least two latch elements being provided at the connector plate externally of the central opening. When an additional connector element is mounted axially onto the connector element in a predetermined angular position with respect to the first connector element, corresponding latch elements thereof are rotationally fixed with corresponding latch elements of the first connector element. This is characterized in that the connector element has a security against rotation which is suitable for cooperating with the bolt extending through the central opening.

European Patent document EP 0 663 703 A2 shows a stackable contact part in which two tabs per contact are folded over on the outer side and point inwardly to establish the attachment to the adjacent contact part. However, the rotation lock between the contact parts is inadequate.

SUMMARY

Embodiments of the present disclosure may provide a better opportunity for the stacked connection of several contact elements, particularly cable lugs.

Embodiments of the present disclosure provide a contact element comprising a connector plate with a central inner opening and a conductor receptacle extending outwardly from the connector plate, wherein the connector plate has at least one pair consisting of a first area (hereinafter referred to as a "plug area" without limiting the generality of the subject matter) and a second area (hereinafter referred to as a "jack area" without limiting the generality of the subject matter). The plug area and the jack area of each particular pair are angularly offset around the center of the inner opening by a predetermined offset angle, and vertically offset from the connector plate, and configured such that they can be pushed into engagement when positioned opposite and vertically offset from one another.

Embodiments of the present disclosure provide a contact element comprising a connector plate having a central inner opening, and a conductor receptacle extending outwardly from the connector plate. The connector plate comprises a first pair of connection areas and a second pair of connection areas. The first pair of connection areas comprises a first plug area having a first protrusion oriented radially toward a center of the inner opening; and a first jack area having a second protrusion oriented radially away from the center of the inner opening; the first plug area and the first jack area being angularly offset by a specified offset angle around the center of the inner opening and being vertically offset from one another perpendicularly to the connector plate. The second pair of connection areas comprises a second plug area having a third protrusion oriented radially away from the center of the inner opening; and a second jack area having a fourth protrusion oriented radially toward the center of the inner opening; the second plug area and the second jack area being angularly offset by the offset angle around the center of the inner opening and being vertically offset from one another perpendicularly to the connector plate. The first and second pairs of connection areas are configured to respectively couple with vertically offset third and fourth pairs of connection areas of a second contact element.

Embodiments of the present disclosure provide a ground terminal lug for transferring a ground current onto a vehicle body, the ground terminal lug comprising a substantially annular connector plate and a conductor receptacle extending outwardly from a section of the connector plate. The connector plate further comprises a central inner opening having a center and at least four sides; a first plug area having a first protrusion oriented radially toward a center of the inner opening; a first jack area having a second protrusion oriented radially away from the center of the inner opening, the first plug area and the first jack area being angularly offset by a specified offset angle around the center of the inner opening and being vertically offset from one another perpendicularly to the connector plate; a second plug area having a third protrusion oriented radially away from the center of the inner opening; and a second jack area having a fourth protrusion oriented radially toward the center of the inner opening, the second plug area and the second jack area being angularly offset by the offset angle around the center of the inner opening and being vertically offset from one another perpendicularly to the connector plate. The first and second plug areas of the contact element are configured to respectively engage with corresponding vertically offset third and fourth jack areas of a second contact element.

According to embodiments of the present disclosure, an additional contact element may be placed onto the first contact element at the predetermined offset angle but laterally offset (and thus vertically offset from the first contact element), such that the then facing, corresponding plug areas and jack areas of the two contact elements can be brought into mutual engagement by a lateral relative movement, which can also be referred to as a plugged connection or establishment of a plugged connection. The corresponding plug areas and jack areas together with the connector plate cause the two contact elements to interlock perpendicularly to the connector plate, preventing them from being dislodged.

According to embodiments of the present disclosure, a secure connection of the two contact elements can be achieved without making the connection (as in the prior art) by vertically aligning the superimposed connector plates and, where applicable, subsequently rotating them.

According to embodiments of the present disclosure, the two contact elements can also be secured against mutual rotation. In addition, connection of the two connector plates over a large area is accomplished. When the contact elements are joined together, a gap between the connector plates can be avoided. This may prevent or reduce crushing on being screwed down, and simplify disassembly. A ground bolt may be inserted through the inner openings to further secure the two contact elements to one another.

According to embodiments of the present disclosure, any number of contact elements can be connected or joined in a superimposed relationship, or the contact elements can be stacked any number of times.

According to embodiments of the present disclosure, the plug area or the jack area of a pair has a protrusion oriented radially to the center of the inner opening and the respective other jack area or plug area of this pair has a protrusion oriented radially away from the center of the inner opening. Thus, these areas have protrusions extending in opposite directions. Accordingly, the plug connection can be achieved by pushing the protrusions together. The protrusions, for example, can be provided in the form of tab-like, knife-shaped or stub-like protrusions. To facilitate pushing them together, they can taper to a point at their free end. In the simplest case one pair is sufficient to attach two superimposed contact elements.

According to embodiments of the present disclosure, the contact element can also be referred to as a connector element. For example, the contact element can be a ground terminal lug or a cable lug. The contact element may be made of metal, e.g., copper or brass, specifically a sheet metal part, such as one with a given strength or thickness.

According to embodiments of the present disclosure, the contact element can be embodied to be plugged onto a ground connection, specifically onto a mass bolt. The contact element can be used to transfer a ground current onto a vehicle body.

According to embodiments of the present disclosure, the connector plate is substantially annular, with two flat sides, an inner edge and an outer edge. The inner edge and/or the outer edge can be irregular in shape. The inner edge encloses the central inner opening. The central inner opening can be provided for mounting the contact element, such as a ground connection, onto a bolt. The bolt can be the ground bolt of a vehicle, e.g., the body of a motor vehicle or a cell of an airplane.

According to embodiments of the present disclosure, the bolt, such as the ground bolt of a vehicle, has a collar for the contact elements to rest on. The collar can prevent prestressing forces that can act on a connection (such as a weld) between the bolt and a body attached to it (such as the body of a motor vehicle) when the contact elements are screwed in place. In addition, the collar creates a mechanically closed or cohered system with reference to the contact elements. For example, if the ground bolts detach from the body, the contact elements will still be held together.

According to embodiments of the present disclosure, the collar is positioned between the connection or between the body and the contact elements, and can be embodied in the shape of a disk.

According to embodiments of the present disclosure, the bolt has a hexagonal-edged base that transitions at the lower end, for example, into a vehicle body (not shown) and at the upper end into a screw thread. The inner openings of the contact elements are specially adapted to fit onto the base. If a collar is provided, it may be located at the underside of the base or on the lower side of an end section of the base. The collar may be concentric with the base.

According to embodiments of the present disclosure, the conductor receptacle can extend radially from the outer edge of the connection plate. The conductor receptacle can be a crimp connection for a single conductor such as a cable. However, several single conductors can also be combined into one crimp connection. Moreover, the at least one conductor can also be welded onto the contact element.

According to embodiments of the present disclosure, the plug area and the jack area in particular are vertically offset such that a gap of approximately one thickness of the connector plate separates them in a direction (a "vertical direction") perpendicular to the plane of the connector plate. Thus, when two contact elements are pushed together, the plug area and the jack area glide into mutual engagement, thereby preventing vertical play between the two contact elements.

According to embodiments of the present disclosure, the plug area of a particular pair is elevated relative to a flat side of the connector plate and the jack area of the same pair is elevated relative to another flat side of the connection plate, that is, in different directions. In this way a compact contact element can be provided. The plug area and the jack area can each be elevated in different directions by approximately one thickness of the connector plate.

According to embodiments of the present disclosure, the plug area and the jack area, for example, can be created using a molding process, for instance by embossing and/or punching the connector plate.

According to embodiments of the present disclosure, the connector plate has several pairs, each including a plug area and a jack area. A secure connection of two superimposed contact elements can be achieved as a result.

According to embodiments of the present disclosure, the plug areas of at least two pairs are arranged facing one another with respect to the center of the inner opening. A secure connection of two superimposed contact elements can be achieved in this way. Thus, the jack areas of these at least two pairs are arranged facing one another with respect to the center of the inner opening. Therefore, these plug areas or jack areas of two pairs are not rotationally symmetrical, but rather complementary under rotation. When the contact element is rotated by 180° around a vertical axis passing through the center of the inner opening or around a plane of the plate, the protrusion of the plug area or the jack area in this position points in a different direction than the protrusion located at this point when the contact element has not been rotated.

According to embodiments of the present disclosure, the protrusions opposite each other point in the same direction with respect to the center of the inner opening. This facilitates a lateral mutual engagement of two contact elements.

According to embodiments of the present disclosure, the connector plate has exactly two such pairs. This ensures a secure connection at a low manufacturing effort. These two pairs in particular are complementary under rotation by 180° in the plane of the plate.

According to a further embodiment of the present disclosure, the connector plate has a latch hook or a latch tab, and a latch receiver, such a latch slot that is angularly offset by a pre-determined offset angle. In this way, not only can two contact elements be interconnected as described above; they can also be interlocked and thus secured in a simple manner. In particular, backlash of a lateral shift or plug movement may be prevented. No particular latching motion is required, since the latching action may be performed automatically with the lateral push together or plug together of two contact elements. The latch hook or latch tab can be arranged parallel to a plug area or a jack area. The latch receiver can be arranged parallel to a plug area or a jack area. A plug area or a jack area is arranged between the latch tab and latch slot.

According to embodiments of the present disclosure, the inner opening is an n-sided opening, and the offset angle is 360°/n wherein n is at least 4. In this way, similar contact elements with a uniform angular offset can be superimposed on each other. According to embodiments of the present disclosure, the value n=6 provides a compromise between easy handling and manufacturing on the one hand and a broad spatial distribution of single wires attached to the holders on the other. However, other values of n are contemplated and the value of n=6 is not intended to limit the scope of the present disclosure.

According to a further embodiment of the present disclosure, a height of the (occupied or unoccupied) conductor receptacle is less than n times a thickness of the connector plate. Thus, in a superimposed or stacked arrangement of n+1 (or more) contact elements, the conductor receptacle does not obstruct attachment of the $(n+1)^{th}$ contact element to the first (or $n^{th}$) contact element, which is aligned to be congruent with it.

According to a further embodiment of the present disclosure, the inner opening has corners. In this way, when the contact element or stack is mounted onto a bolt with a fitting shape, security against rotation can be achieved, since the bolt can absorb torque exerted by the contact elements, thus acting as protection from rotation.

According to embodiments of the present disclosure, the inner opening—particularly at an offset angle of (360/n)°—can be an inner opening with n corners or it can be embodied for the non-rotational accommodation of an n-sided bolt.

According to embodiments of the present disclosure, a set of several superimposed or stacked contact elements as described above is disclosed, with two superimposed contact elements lying one on the other over a large area of their connector plates and angularly offset by an offset angle, with the at least one plug area of one of the two contact elements engaging with a particular jack area of the particular other of the two contact elements.

Embodiments of the present disclosure disclose a method of connecting two similar contact elements, both having a connector plate with a central inner opening and a conductor receptacle extending outwardly from the connector plate. The two contact elements are adapted to be engaged by a lateral motion parallel to a plane of their connector plates in such a way (particularly by being plugged together), that their inner openings are superimposed and the connector plates are positively connected to each other perpendicularly to the plane.

Embodiments of the present disclosure provide a method of connecting a first and second contact element, the contact elements each having a connector plate with a central inner opening and a conductor receptacle extending outwardly from the connector plate, the method comprising laterally moving the first contact element with respect to the second contact element parallel to a plane of the connector plates; and superimposing the central inner openings of the first and second connector plates such that the connector plates are engaged to one another perpendicularly to the plane.

Embodiments disclosing the method may include the same elements as those embodiments disclosed above.

According to embodiments of the present disclosure, the lateral movement can interlock the two connector plates against a counter-movement.

According to embodiments of the present disclosure, the two contact elements can be joined together using an electrical conductor that has already been attached in the conductor receptacle.

The described properties of the present disclosure and the manner in which these are achieved will be described in more detail based on the following detailed description. The foregoing general description and the following detailed description are exemplary and explanatory only, and are not restrictive of embodiments consistent with the present disclosure. Further, the accompanying drawings illustrate embodiments of the present disclosure, and together with the description, serve to explain principles of the present disclosure.

DETAILED DESCRIPTION

Figure 1:
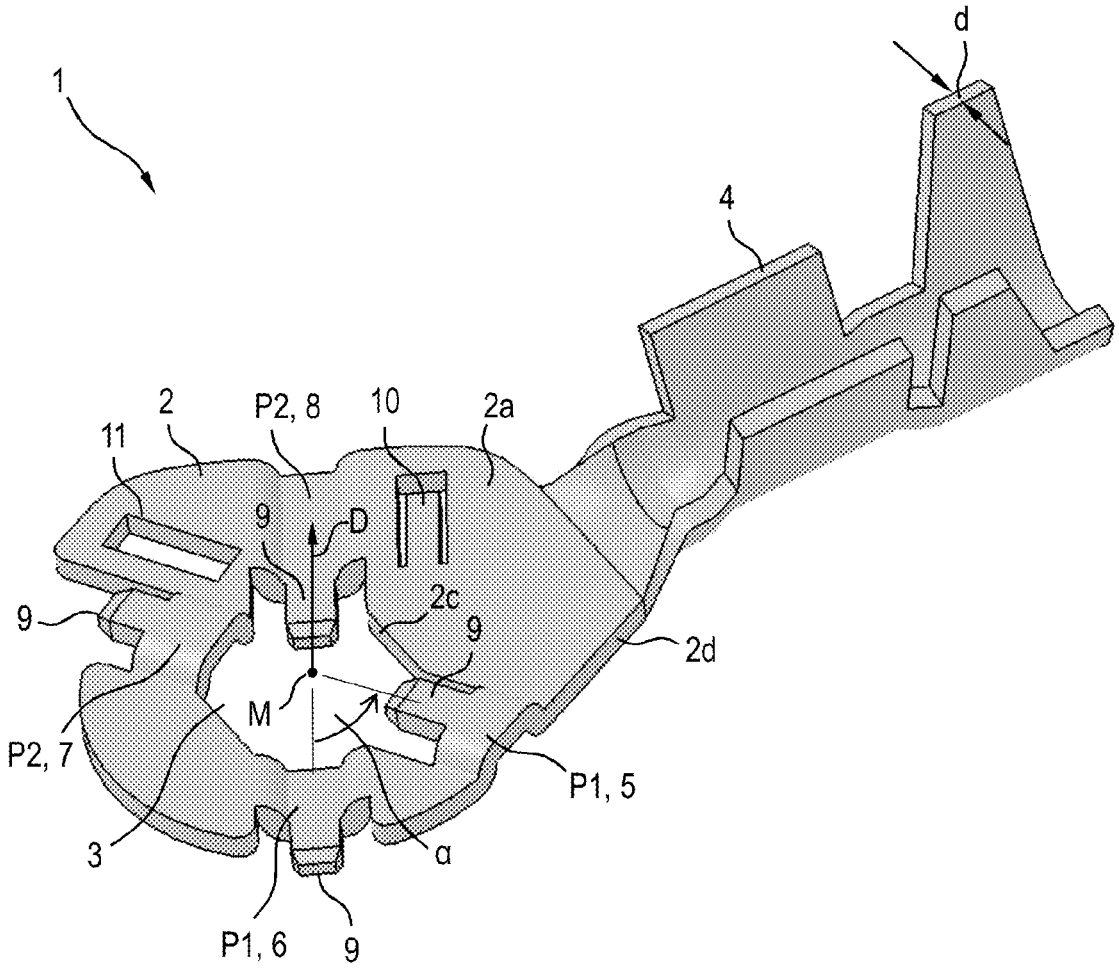
FIG. 1 shows an inclined top view of an exemplary contact element.
Figure 3:
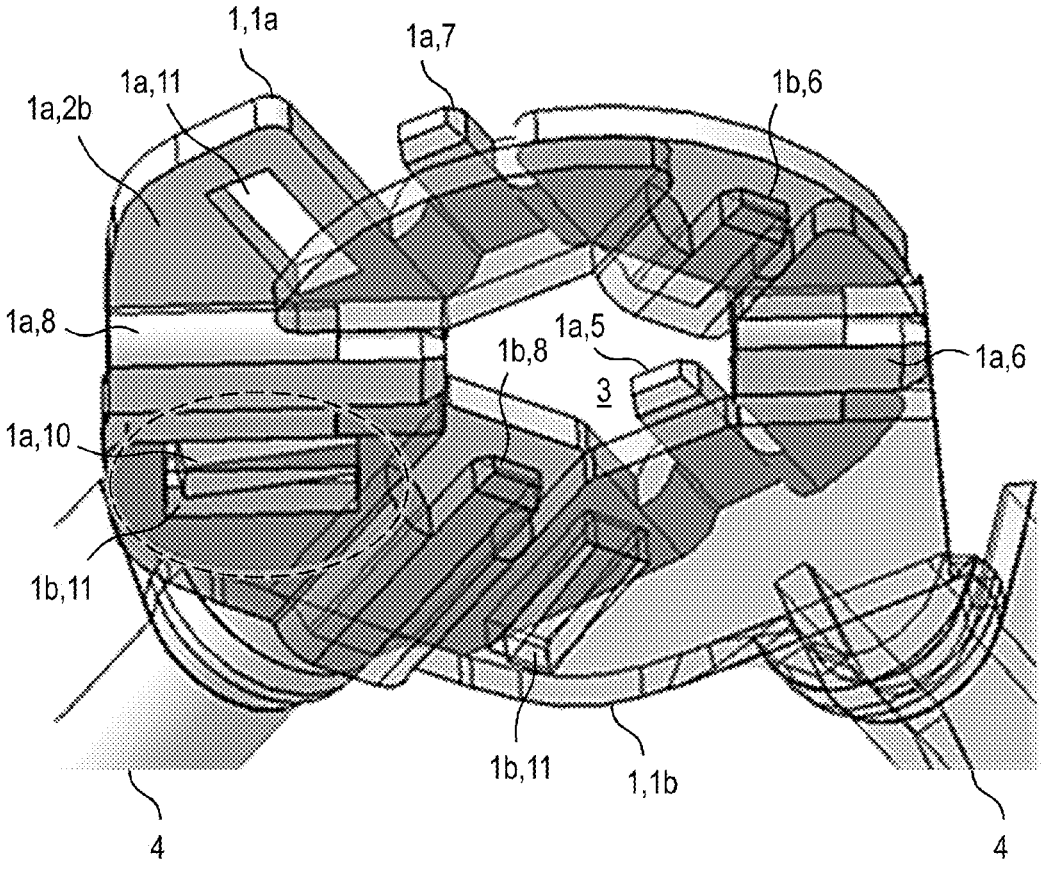
FIG. 3 shows an inclined view from below of two exemplary contact elements, with the lower contact element represented as being transparent.

FIG. 1 shows an inclined top view of an exemplary contact element 1 comprising an annular connector plate 2 with a central inner opening 3. The contact element 1 has two flat sides (the upper flat side 2*a* is shown in FIG. 1; the lower flat side 2*b* is shown in FIG. 3), an inner edge 2*c* and an outer edge 2*d*. The contact element 1 is a metallic sheet-metal part, for example made of copper, with a thickness d. A conductor receptacle in the shape of a crimp area 4 extends radially outwardly from the outer edge 2*d* of the connector plate 2. The conductor receptacle can alternatively also be embodied as a welding zone, for example.

A first pair P1 composed of a first plug area 5 and a first jack area 6 and a second pair P2 composed of a second plug area 7 and a second jack area 8 are formed on the connector plate 2. The first plug area 5 and the first jack area 6 and/or the second plug area 7 and the second jack area 8 are angularly offset from one another by specified offset angles α around a center M of the inner opening 3, namely with respect to a rotation about an axis D perpendicularly to the plane of a plate of the connector plate 2.

The first plug area 5 and the first jack area 6 and/or the second plug area 7 and the second jack area 8 are vertically offset in a direction perpendicular to the connector plate 2 (i.e. also along the axis D). Both plug areas 5, 7 here are elevated toward the upper flat side 2*a* of the connector plate 2 and the two jack areas 6, 8 are elevated toward the lower flat side 2*b*. The plug areas 5, 7 and the jack areas 6, 8 can each be elevated by approximately an entire thickness d of the connector plate 2 or offset from the remainder of the connector plate 2, such that in relation to their vertical position (along the axis D) they are offset from each other by two thickness values 2.*d* of the connector plate 2. A lower side of a plug area 5, 7 is therefore at least approximately spaced apart by one thickness d of the connector plate 2 from an upper side of a jack area 6, 8.

The plug areas 5, 7 and the jack areas 6, 8 each have a protrusion 9 that is radially oriented to the center M of the inner opening 3. Specifically, the protrusion 9 of the first plug area 5 is oriented toward the center M of the inner opening 3, while the protrusion 9 of the second plug area 7 is oriented away from the center M of the inner opening 3. In a complementary fashion the protrusion 9 of the first jack area 6 is oriented away from the center M of the inner opening 3, while the protrusion 9 of the second jack area 8 is oriented toward the center M of the inner opening 3. The protrusions 9 of the plug areas 5 and 7 thus point in a different direction with respect to the center M. The protrusions 9 of the jack areas 6 and 8 similarly point in a different direction with respect to the center M. Thus, the protrusions 9 of the plug areas 5 and 7 point in the same direction when viewed from the outside and the same applies for the protrusions 9 of the jack areas 6 and 8.

The connector plate 2 may include a latch tab 10 cut into the plate and bent away from the plate. The connector plate 2 may include a latch receiver, for example, a latch slot 11 that is angularly offset by an offset angle α. The latch tab 10 is oriented parallel to the jack areas 6 and 8, while the latch slot 11 is oriented parallel to the plug areas 5 and 7.

The offset angle α here may have a value of 360°/6=60° at n=6. The inner opening 3 is designed accordingly for the non-rotating accommodation of a hexagonal bolt B (see FIGS. 4 to 6).

Starting from the crimp area 4 the connector plate 2 may thus comprise the following, listed in a peripheral direction and counter-clockwise: the latch tab 10, the second jack area 8, the latch slot 11, the second plug area 7, the first jack area 6 and the first plug area 5.

Figure 2:
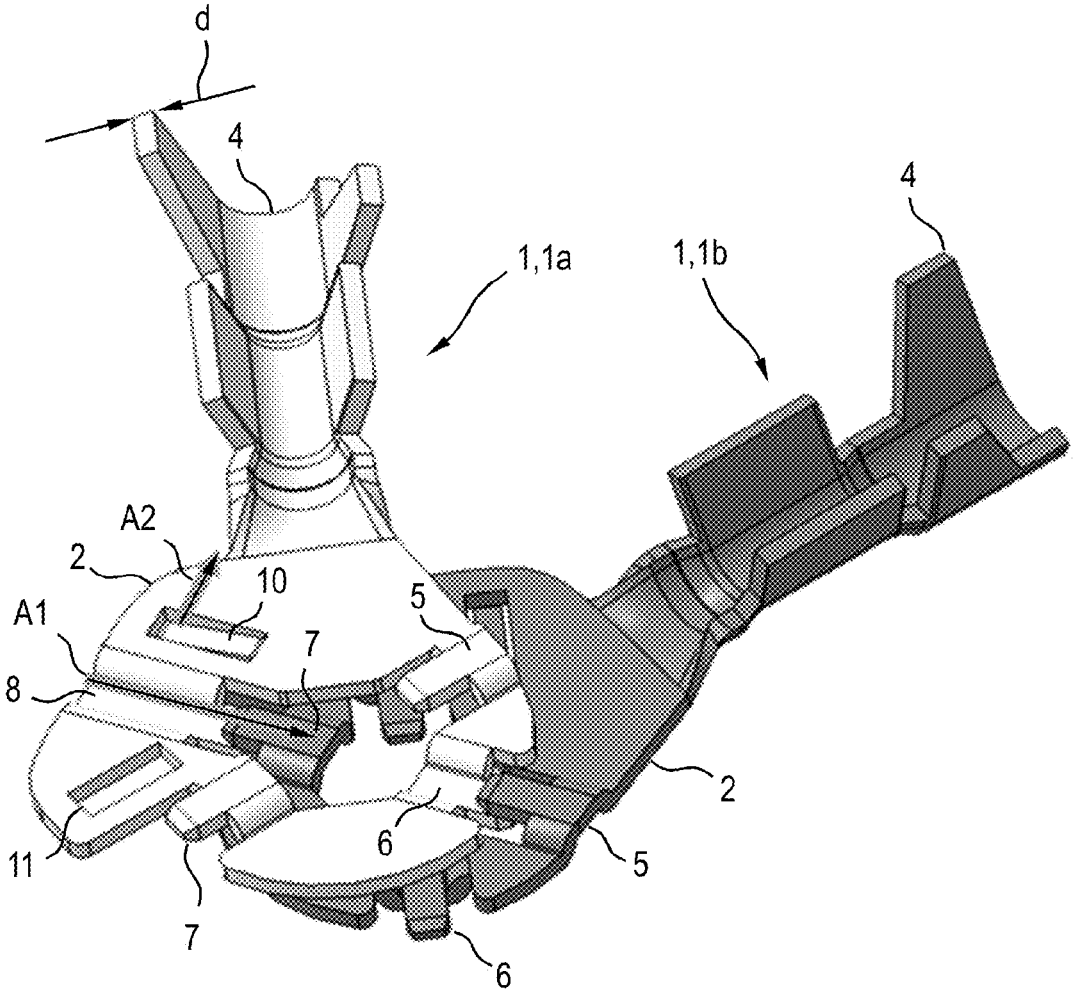
FIG. 2 shows an inclined top view of two exemplary contact elements to be plugged together.

FIG. 2 shows an inclined top view of two exemplary contact elements 1, 1*a* and 1, 1*b* (also referred to herein as "1*a*" and "1*b*" respectively), configured to be plugged together, of which the upper contact element 1*a* is depicted in the figures as lighter and the lower contact element 1*b* is depicted as darker. The contact elements 1*a* and 1*b* are equivalent parts. The upper contact element 1*a* is rotated relative to the lower contact element 1*b* by α=60° and is also laterally offset. The upper contact element 1*a* is vertically offset relative to the lower contact element 1*b* by a distance corresponding to the thickness d of the connector plate 2.

To assemble or join the two contact elements 1, the upper contact element 1*a* is placed on the lower contact element 1*b* at a lateral and angular offset, in such a manner that jack area 6 of upper contact element 1*a* projects into the opening 3 of the lower contact element 1*b* and lies facing the first plug area 5 of the lower contact element 1*b*. This causes the second jack area 8 of the upper contact element 1*a* to also lie facing the second plug area 7 of the lower contact element 1*b*. The plug areas 5, 7 of the lower contact element 1*b* are now offset relative to the jack areas 6, 8 of the upper contact element 1*a* by a thickness d.

The upper contact element 1*a* is then displaced laterally against the lower contact element 1*b* (as indicated by the arrow A1) such that the connector plate 2 of the upper contact element 1*a* glides onto the connector plate 2 of the lower contact element 1*b*, and the jack areas 6, 8 of the upper contact element 1*a* also glide underneath the plug areas 5, 7 of the lower contact element 1*b*. The jack areas 6, 8 of the upper contact element 1*a* and the plug areas 5, 7 of the lower contact element 1*b* come into (lateral) engagement with one another and forming a plug connection. Here the contacting plug areas 5, 7 and/or jack areas 6, 8 can be elastically bent, so that the two connector plates 2 are pressed together over a large area. The upper contact element 1*a* is prevented from moving downwardly by the connector plate 2 of the lower contact element 1*b* and from moving upwardly by the plug areas 5, 7 of the lower contact element 1. This prevents a vertical lifting of the two contact elements 1*a* and 1*b* from one another. This plug connection also prevents rotation of the contact elements 1*a* and 1*b* against each another.

When the contact elements 1*a* and 1*b* are pushed together, the latch tab 10 of the upper contact element 1*a* is pressed by the connector plate 2 of the lower contact element 1*b* into its cutout (as indicated by the arrow A2) and subsequently engages with the latch slot 11 (not shown) of the lower contact element 1*b*, and the latch tab 10 springs back into the latch slot 11. Thus the two contact elements 1*a* and 1*b* are secured against separation caused by being laterally pushed apart with no need for an independent securing movement.

Before the joining, an electrical lead such as a cable, may have been crimped into the crimp area 4 (or alternatively welded). Thus, the electrical lead can be crimped or welded onto the contact element prior to assembly of the contact elements.

FIG. 3 shows an inclined view from below of two plugged-together contact elements 1*a* and 1*b*, with the lower contact element 1*b* shown as being transparent. The latching of the latch tab 10 in the latch slot 11 is shown in the area circled in by a broken line.

The connector plates 2 of the two contact elements 1*a*, 1*b* are superimposed over a large area. In particular, the two inner openings 3 lie together in such a manner that their centers M are congruent. A hexagonal bolt can be passed through the two inner openings 3, thereby preventing mutual rotation of the contact elements 1*a* and 1*b*. The two inner openings 3, when assembled, thus fit on the hexagonal bolt.

The plug areas 5, 7 of the upper contact element 1*a* and the jack areas 6, 8 of the lower contact element 1*b* are not used for the joining. They can be connected with additional contact elements 1 or with a particular compensating disk, as described in greater detail below.

Figure 4:
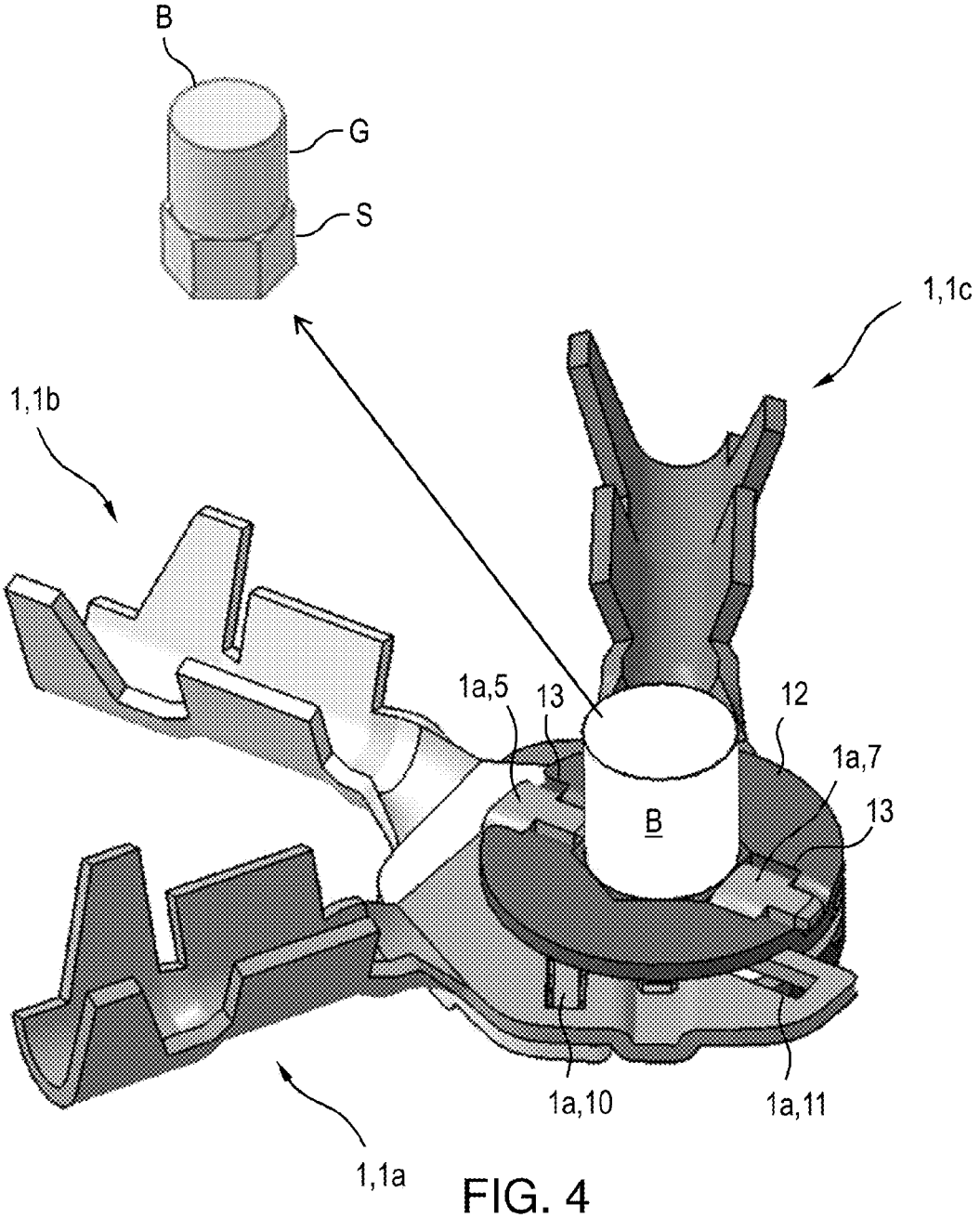
FIG. 4 shows an inclined top view of three exemplary contact elements plugged together and mounted on a bolt together with an additional compensating disk.

FIG. 4 shows an inclined top view of three assembled exemplary contact elements 1*a*, 1*b*, 1*c*, in which the contact elements 1*a* and 1*b* are joined as shown in FIG. 3 and the contact elements 1*b* and 1*c* are joined analogously. The contact elements 1*a*, 1*b* and 1*c* are angularly offset by 60° each around a center of the particular inner openings 3. There are now three inner openings 3 fitted onto a hexagonal bolt B, for example a ground bolt, depicted in FIG. 4 separately at the upper left.

The bolt B has a hexagonal-edged base S that transitions at the lower end, for example, into a vehicle body (not shown) and at the upper end into a screw thread G. The inner openings 3 fit onto the base S.

To provide a large-area support surface for a nut E (see FIG. 7) to be screwed onto the screw thread S, in order to keep the plug areas 5, 7 of the upper contact element 1*a* from bending and to enable a uniform joining pressure to be exerted on the plugged-together contact elements 1*a*, 1*b* and 1*c*, an annular disk (such as "compensating disk" 12) is placed on the uppermost contact element 1*a*. The disk has two recesses 13 for the flush accommodation of the plug areas 5, 7 of the upper contact element 1*a* and two protrusions 9 similar to those of the contact element 1. The compensating disk 12 may be urged onto the upper contact element 1*a* in a manner similar to a connector plate 2. The compensating disk 12 may have the same thickness d as the contact elements 1*a*, 1*b* and 1*c*. The compensating disk 12 (see FIG. 10) can have a hexagonal inner opening.

Analogously, a lower compensating disk (not shown) can be provided to accommodate the jack areas 6, 8 of the lower corresponding contact element 1*b* so as to be flush across an area and to achieve a uniform pressure on a carrier of the bolt B.

Figure 5:
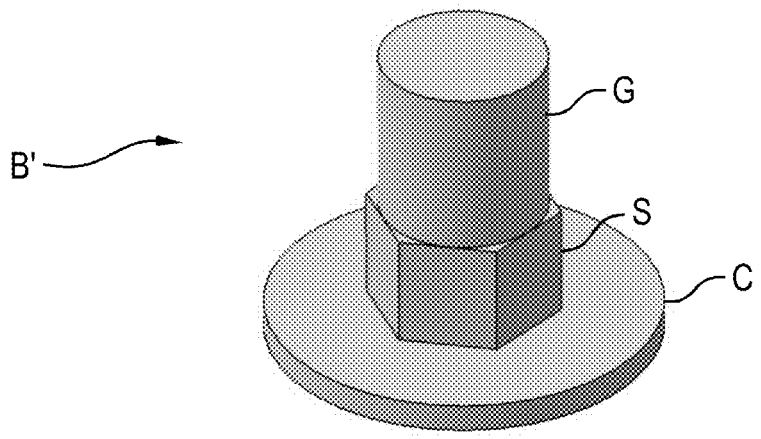
FIG. 5 shows an inclined view of an alternative use of a bolt.

FIG. 5 shows an inclined top view of a bolt B' that can be used as an alternative in some embodiments.

Figure 6:
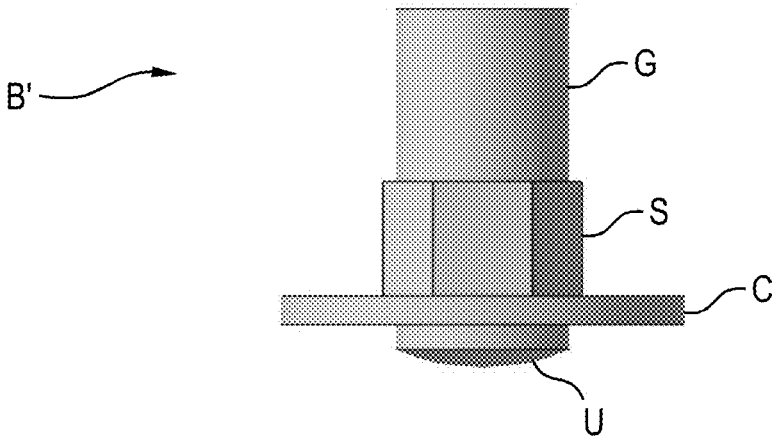
FIG. 6 shows a lateral view of the bolt from FIG. 5.

FIG. 6 shows a lateral view of the bolt B'. The bolt B', which can be used as a ground bolt, has a hexagonal base S, as with the bolt B from FIG. 4, that transitions at the upper end into a screw thread G. On the side of the base S facing the screw thread G there is a disk-shaped collar C to support the contact elements 1*a*, 1*b*, 1*c*, from which an overhang U can project, as shown in FIG. 6. The overhang U can be used for attachment of the bolt B' (for instance to weld it on) to a vehicle body or another body, for example. The base S stands centrally or centrically and perpendicularly forward from collar C.

Collar C can keep the pre-stressing forces occurring when the contact elements 1*a*, 1*b*, 1*c* are screwed into place from acting on a connection (such as a welded connection) between the bolt B' and, for example, a vehicle body. In addition, a mechanically closed or held-together system is created by the collar C with reference to the contact elements 1*a*, 1*b*, 1*c*. For example, if the bolt B' is released from the body, the contact elements 1*a*, 1*b*, 1*c* will still be held together between the nut E and the collar C. The collar C, for example can function in a manner similar to that of a shim.

Figure 7:
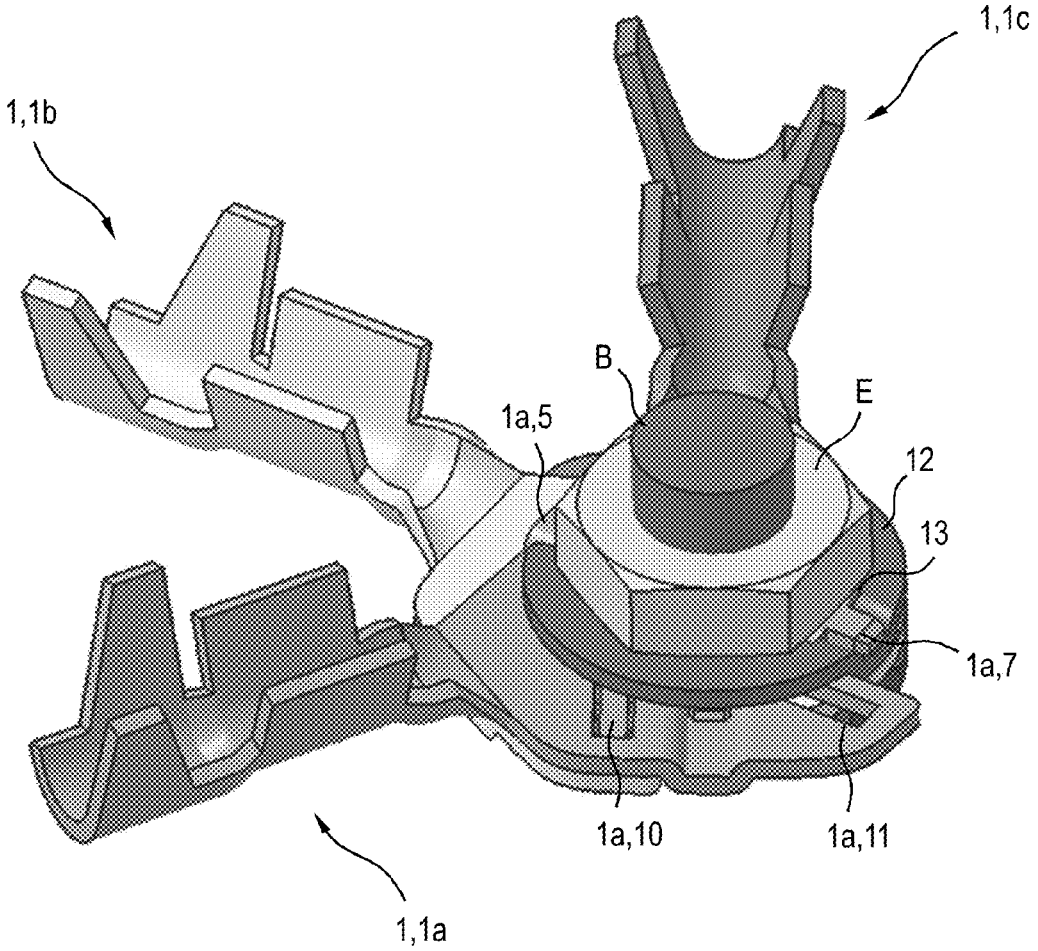
FIG. 7 shows an inclined top view of the contact elements and the compensating disk from FIG. 4, now affixed to the bolt by a nut.

FIG. 7 shows an inclined top view of the contact elements 1*a*, 1*b*, 1*c* (and recess 13) that are now affixed by the bolt B or B' and by a nut E.

Figure 8:
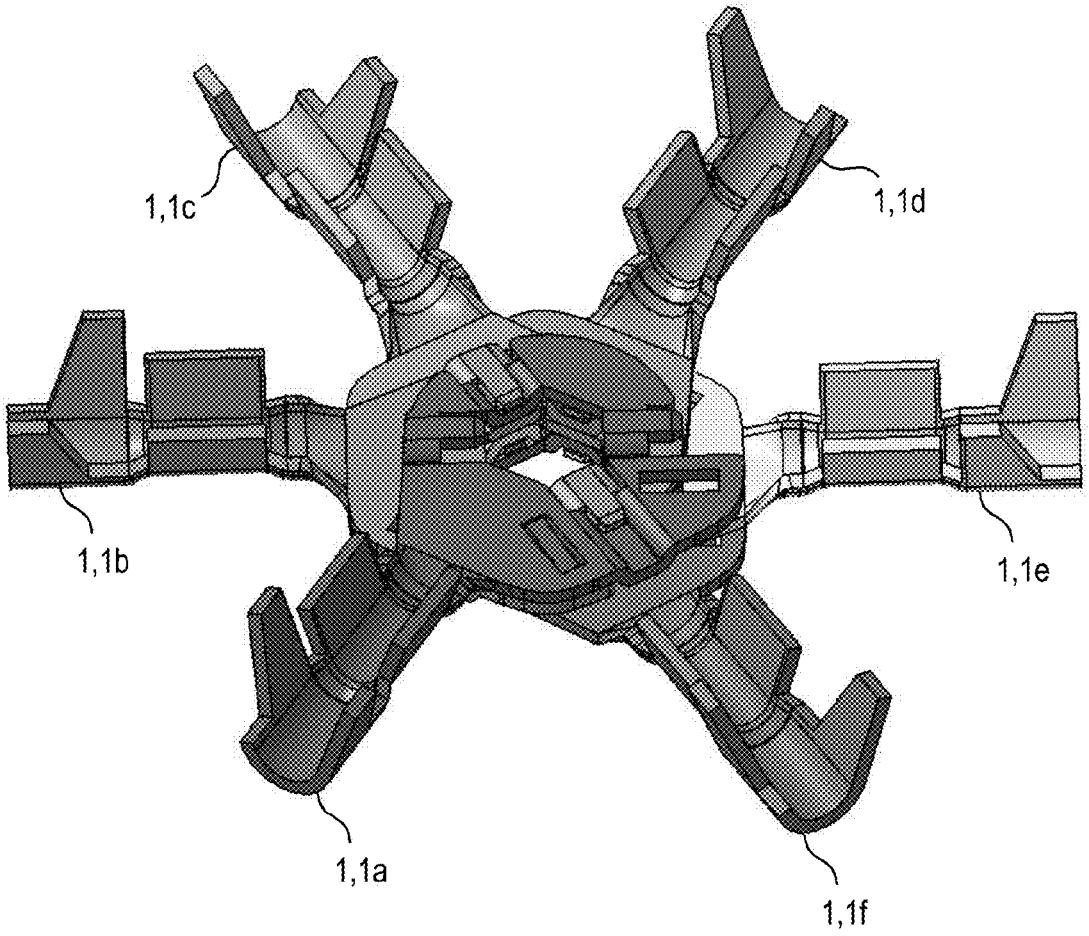
FIG. 8 shows an inclined top view of six stacked exemplary contact elements.

FIG. 8 shows an inclined top view of six stacked exemplary contact elements 1*a* to 1*f* having equivalent parts. They are angularly offset from one another by 60° each. It is contemplated to add another contact element 1 at the top or bottom, since the height of the (uncrimped or crimped) crimp area 4 is less than six times the thickness d of the particular connector plates 2.

Figure 9:
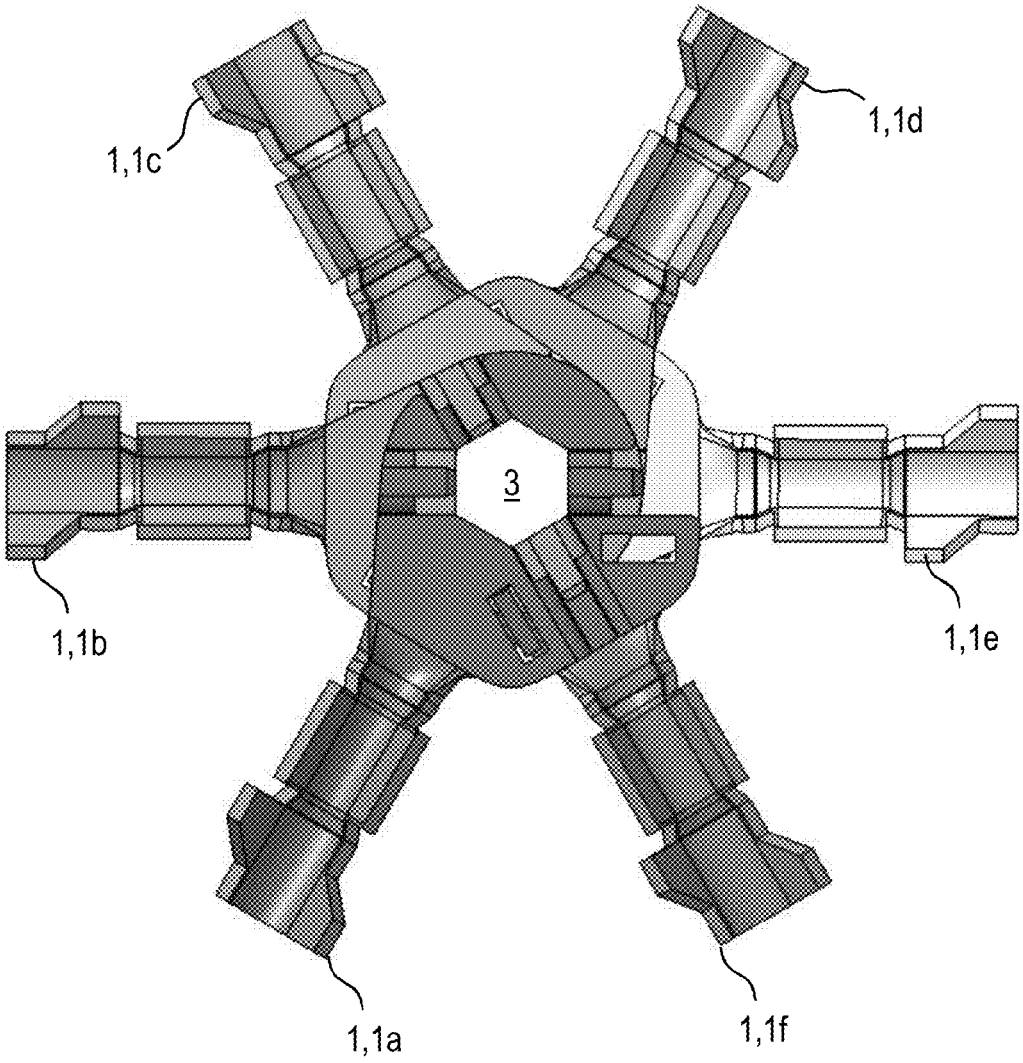
FIG. 9 shows a top view of the six stacked contact elements from FIG. 8.

FIG. 9 shows a plan view of the six stacked contact elements 1*a* to 1*f* from FIG. 8. The inner openings 3 in the plan view form a hexagon into which the base S of the bolt B or B' fits.

It will be appreciated that the present disclosure is not limited to the embodiment illustrated.

For example, instead of an angular offset of 60°, an angular offset of 120°, 90°, or 45° can be used.

In general, by "one", a singular or plural may be understood, particularly in the sense of "at least one" or "one or more", etc., as long as this is not explicitly ruled out, for instance by the expression "exactly one."

For example, when a particular contact element is described as being moved to join with another contact element, it is understood that either contact element may be moved in relation to the other for the joining.

Also, a number can indicate precisely the given number or it can also include a customary tolerance range, as long as this is not expressly ruled out.

LIST OF REFERENCE NUMERALS

1 contact element
1*a-c* contact elements
2 connector plate
2*a* upper flat side of the connector plate
2*b* lower flat side of the connector plate
2*c* inner edge of the connector plate
2*d* outer edge of the connector plate
3 inner opening
4 crimp area
5 first plug area
6 first jack area
7 second plug area
8 second jack area
9 protrusion

10 latch tab
11 latch slot
12 compensating disk
13 recess in the compensating disk
α offset angle
A1 arrow
A2 arrow
B bolt
B' bolt
C collar
D axis
d thickness of the connector plate
E nut
G screw thread of the bolt
M center of the inner opening
P1 first pair
P2 second pair
S base of the bolt
U lower side overhang

What is claimed is:

1. A contact element, comprising:

a connector plate having a central inner opening, the connector plate comprising:

a first pair of connection areas comprising:

a first plug area having a first protrusion oriented radially toward a center of the inner opening; and a first jack area having a second protrusion oriented radially away from the center of the inner opening;

the first plug area and the first jack area being angularly offset by a specified offset angle around the center of the inner opening and being vertically offset from one another perpendicularly to the connector plate; and a second pair of connection areas comprising:

a second plug area having a third protrusion oriented radially away from the center of the inner opening; and a second jack area having a fourth protrusion oriented radially toward the center of the inner opening;

the second plug area and the second jack area being angularly offset by the offset angle around the center of the inner opening and being vertically offset from one another perpendicularly to the connector plate;

wherein the first and second pairs are configured to respectively couple with vertically offset third and fourth pairs of a second contact element; and a conductor receptacle extending outwardly from the connector plate.

2. The contact element according to claim 1, wherein:

the contactor plate comprises an upper flat side and a lower flat side;

the first and second plug areas are elevated in relation to the upper flat side; and the first and second jack areas are elevated in relation to the lower flat side.

3. The contact element according to claim 2, wherein:

the first and second plug areas are elevated in relation to the upper flat side by a distance substantially equal to a thickness of the contactor plate; and the first and second jack areas are elevated in relation to the lower flat side by a distance substantially equal to the thickness of the contactor plate.

4. The contact element according to claim 1, wherein the connector plate comprises a plurality of pairs of connection areas, each pair comprising a plug area and a jack area.

5. The contact element according to claim 1, wherein the first and second plug areas are arranged along a line extending from the center of the inner opening such that their respective protrusions point in the same direction.

6. The contact element according to claim 1, the connector plate further comprising a latch tab and a latch slot angularly offset from the latch tab by the offset angle, the latch tab and latch slot being configured to interlock with a corresponding latch slot and latch tab, respectively, of the second contact element.

7. The contact element according to claim 6, wherein the latch tab is oriented parallel to the first and second jack areas, and the latch slot is oriented parallel to the first and second plug areas.

8. The contact element according to claim 1, wherein the inner opening is an n-sided inner opening.

9. The contact element according to claim 8, wherein the offset angle is 360°/n, wherein n is at least 4.

10. The contact element according to claim 8, wherein a height of the conductor receptacle is less than n times a thickness of the connector plate.

11. The contact element according to claim 8, wherein the inner opening is a six-sided inner opening configured to engage with a bolt having a hexagonal-edged base.

12. The contact element according to claim 1, wherein the first and second plug areas are vertically offset from the first and second jack areas, respectively, by a distance substantially equal to a thickness of the connector plate.

13. The contact element according to claim 1, wherein the contactor plate is substantially annular and further comprises an upper flat side, a lower flat side, an inner edge, and an outer edge.

14. The contact element according to claim 13, wherein the inner edge of the contactor plate encloses the central inner opening.

15. The contact element according to claim 1, wherein the contact element is a metallic sheet-metal part made of copper.

16. The contact element according to claim 1, wherein the contact element is a ground terminal lug for transferring a ground current onto a vehicle body.

17. The contact element according to claim 1, wherein:

the contact element is a first contact element; and the first and second plug areas of the first contact element are configured to engage with corresponding third and fourth jack areas of the second contact element such that the first and second contact elements are superimposed and angularly offset by an offset angle.

18. A ground terminal lug for transferring a ground current onto a vehicle body, the ground terminal lug comprising:

a substantially annular connector plate further comprising:

a central inner opening having a center and at least four sides;

a first plug area having a first protrusion oriented radially toward a center of the inner opening;

a first jack area having a second protrusion oriented radially away from the center of the inner opening, the first plug area and the first jack area being angularly offset by a specified offset angle around the center of the inner opening and being vertically offset from one another perpendicularly to the connector plate;

a second plug area having a third protrusion oriented radially away from the center of the inner opening; and a second jack area having a fourth protrusion oriented radially toward the center of the inner opening, the second plug area and the second jack area being angularly offset by the offset angle around the center of the inner opening and being vertically offset from one another perpendicularly to the connector plate;

wherein the first and second plug areas of the ground terminal lug are configured to respectively engage with corresponding vertically offset third and fourth jack areas of a second ground terminal lug; and a conductor receptacle extending outwardly from a section of the connector plate.

19. The ground terminal lug according to claim 18, wherein the first and second plug areas are arranged along a line extending from the center of the inner opening such that their respective protrusions point in the same direction.

20. The ground terminal lug according to claim 18, the connector plate further comprising a latch tab and a latch slot angularly offset from the latch tab by the offset angle, the latch tab and latch slot being configured to interlock with a corresponding latch slot and latch tab, respectively, of the second ground terminal lug.

* * * * *